US005500496A

United States Patent [19]

Venzke et al.

[11] Patent Number: 5,500,496

[45] Date of Patent: Mar. 19, 1996

[54] HANDLE ASSEMBLY FOR A CIRCUIT BREAKER

[75] Inventors: Donald R. Venzke, Cedar Rapids; Teresa I. Hood, Coralville; W. Russell Emerick, Cedar Rapids, all of Iowa

[73] Assignee: Square D Company, Palatine, Ill.

[21] Appl. No.: 195,958

[22] Filed: Feb. 14, 1994

[51] Int. Cl.[6] ..... H01H 3/06

[52] U.S. Cl. ..... 200/339; 200/302.3

[58] Field of Search ..... 200/401, 339, 200/302.3, 304, 305

[56] References Cited

U.S. PATENT DOCUMENTS

| | | | |
|---|---|---|---|
| 2,290,495 | 7/1942 | Sandin et al. | 200/339 X |
| 2,829,222 | 1/1958 | Dunham | 200/304 |
| 3,134,881 | 5/1964 | Powell | 200/304 X |
| 3,919,514 | 11/1975 | Strobel et al. | 200/339 X |
| 3,943,316 | 3/1976 | Oster | 200/337 |
| 3,943,472 | 3/1976 | Oster et al. | 335/16 |
| 3,944,953 | 3/1976 | Oster | 335/23 |
| 3,946,346 | 3/1976 | Oster et al. | 335/16 |
| 4,417,223 | 11/1983 | Bancalari | 335/195 |
| 4,642,430 | 2/1987 | Tedesco | 200/401 |
| 4,644,122 | 2/1987 | Farley et al. | 200/304 |
| 4,740,768 | 4/1988 | Morris et al. | 335/22 |
| 5,003,139 | 3/1991 | Edds et al. | 200/401 |
| 5,073,764 | 12/1991 | Takahashi et al. | 335/16 |
| 5,075,657 | 12/1991 | Rezac et al. | 335/6 |
| 5,097,589 | 3/1992 | Rezac et al. | 29/622 |
| 5,159,304 | 10/1992 | Yamagata et al. | 335/202 |
| 5,245,302 | 9/1993 | Brune et al. | 335/35 |

*Primary Examiner*—Renee S. Luebke
*Attorney, Agent, or Firm*—Larry I. Golden; Kareem M. Irfan

[57] ABSTRACT

A handle assembly for a circuit breaker comprises a handle, a handle arm, an inner shield, and an outer shield. The handle includes a base, a shaft, and a first pair of locking members. The shaft extends from an upper surface of the base and the first pair of locking members extend from a lower surface of the base. The handle arm includes a pair of legs and a lateral plate bridging the pair of legs. The pair of legs include a respective second pair of locking members. The second pair of locking members are constructed and arranged to interlock with respective ones of the first pair of locking members so as to lock the handle to the handle arm. The inner and outer shields include respective apertures therein to permit the shields to be disposed over the shaft against the upper surface of the base.

12 Claims, 3 Drawing Sheets

HANDLE ASSEMBLY FOR A CIRCUIT BREAKER

FIELD OF THE INVENTION

The present invention generally relates to circuit breakers, and more particularly, to a handle assembly for a circuit breaker which allows for automated assembly and which protects an operator from possible contact with internal components of the circuit breaker.

BACKGROUND OF THE INVENTION

Circuit breakers are commonly used for providing automatic circuit interruption upon detection of undesired overcurrent conditions on the circuit being monitored. These overcurrent conditions include, among others, overload conditions, ground faults and short-circuit conditions. Circuit breakers typically include an electrical contact on a movable arm which rotates away from a stationary contact in order to interrupt the current path. In response to an overcurrent condition, circuit breakers generally move the arm to break the current path by tripping a spring-biased latch mechanism which forces the arm and its contact away from the fixed contact.

Circuit breakers typically include a handle which allows an operator to operate the circuit breaker and which indicates the present operating mode of the circuit breaker (e.g., "on", "off", "tripped", or "reset"). A drawback of some existing circuit breaker handles is that they do not allow for automated assembly because the handle will not stay in position during assembly without the circuit breaker cover in place. Another drawback of some handles is that they may improperly move while being operated. Yet another drawback of some handles is that they fail to prevent an operator from coming in contact with internal components of the circuit breaker while operating the handle.

Accordingly, there is a need for a handle assembly for a circuit breaker which overcomes the above-mentioned deficiencies of the prior art.

SUMMARY OF THE INVENTION

The present invention provides a handle assembly for a circuit breaker which allows for automated assembly, which prevents unwanted movement while being operated, and which protects an operator from possible contact with internal components of the circuit breaker.

In one particular embodiment, the handle assembly includes a handle, a handle arm, an inner shield, and an outer shield. The handle and the handle arm include respective interlocking members for locking the handle on to the handle arm. This interlocking feature allows for automated assembly because with the handle attached to the handle arm, the handle will stay in position during assembly of the circuit breaker without the circuit breaker cover in place. In addition, this interlocking feature prevents any unwanted movement of the handle while being operated.

The handle includes a shaft extending from a base. The inner and outer shields include respective apertures to permit the shields to fit over the handle shaft. In the assembled form of the handle assembly, the inner and outer shields are disposed over the handle shaft such that the inner shield abuts an upper surface of the base and the outer shield abuts the inner shield. With regard to the circuit breaker enclosure, these shields are sandwiched between the upper surface of the handle base and the cover of the enclosure. The shields prevent an operator from coming into contact with the internal components of the circuit breaker while operating the handle.

BRIEF DESCRIPTION OF THE DRAWINGS

Other objects and advantages of the invention will become apparent upon reading the following detailed description and upon reference to the drawings in which.

Figure 1:
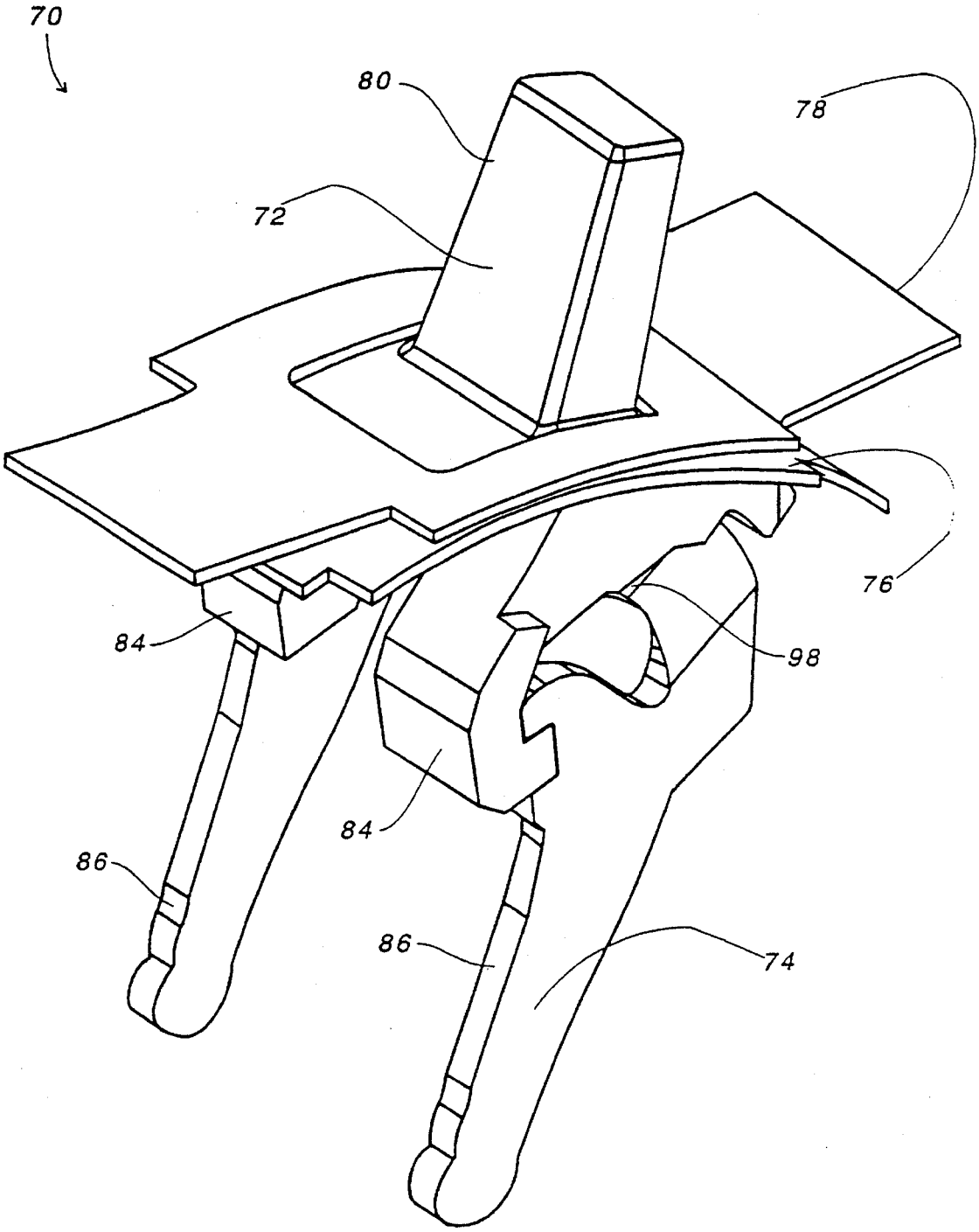
FIG. 1 is a perspective view of a handle assembly embodying the present invention.

While the invention is susceptible to various modifications and alternative forms, specific embodiments thereof have been shown by way of example in the drawings and will be described in detail. It should be understood, however, that the described embodiments are not intended to limit the invention to the particular form described. On the contrary, the intention is to cover all modifications, equivalents, and alternatives falling within the spirit and scope of the invention as defined by the appended claims.

DETAILED DESCRIPTION OF THE PREFERRED EMBODIMENT

Figure 2:
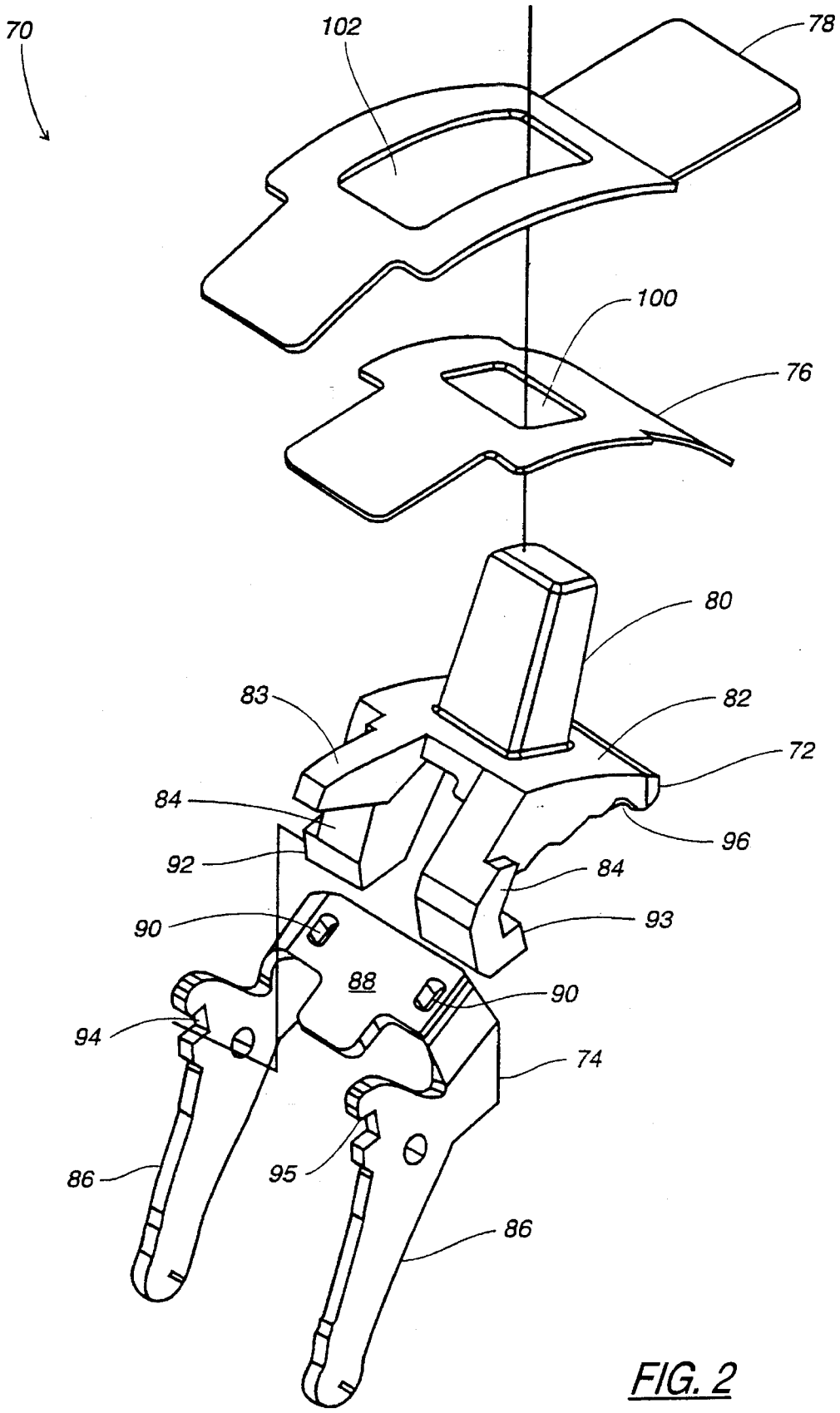
FIG. 2 is an exploded perspective view of the handle assembly in FIG. 1.

Referring now to FIGS. 1 and 2, a handle assembly 70 includes a handle 72, a handle arm 74, a curved inner shield 76, and a curved outer shield 78. The handle 72 includes a shaft 80 extending upwardly from a base 82. Furthermore, a pair of locking members 84 extend downwardly from the base 82 in an opposite direction relative to the shaft 80. The handle arm 74 is provided with a pair of legs 86 for pivotally mounted the handle arm 74 to the mechanism frame sides 24 of a blade/cradle assembly depicted in FIG. 3. These legs 86 are bridged by a lateral plate 88 having a pair of apertures 90 formed therein. The apertures 90 are used to secure one end of the toggle springs 48 of the cradle/blade assembly (see FIG. 3).

To interlock the handle 72 and the handle arm 74, the locking members 84 of the handle 72 are provided with nubs or protrusions 92, 93 and the legs 86 of the handle arm 74 are provided with locking recesses 94, 95. The protrusions 92, 93 engage with the respective locking recesses 94, 95 to lock the handle 72 to the handle arm 74. The lower surface also forms a lateral retention ledge 96 which abuts the upper lateral edge of the lateral plate 88 so as to provide the lock between the handle 72 and the handle arm 74 with clamping reinforcement. FIG. 2 depicts the manner in which the handle 72 is locked to the handle arm 74. In particular, the handle 72 is positioned relative to the handle arm 74 such that the protrusions 92, 93 are adjacent the respective locking recesses 94, 95 and the retention ledge 96 is bearing against the upper lateral edge of the lateral plate 88. The protrusions 92, 93 are then laterally moved into the respective recesses 94, 95.

Figure 3:
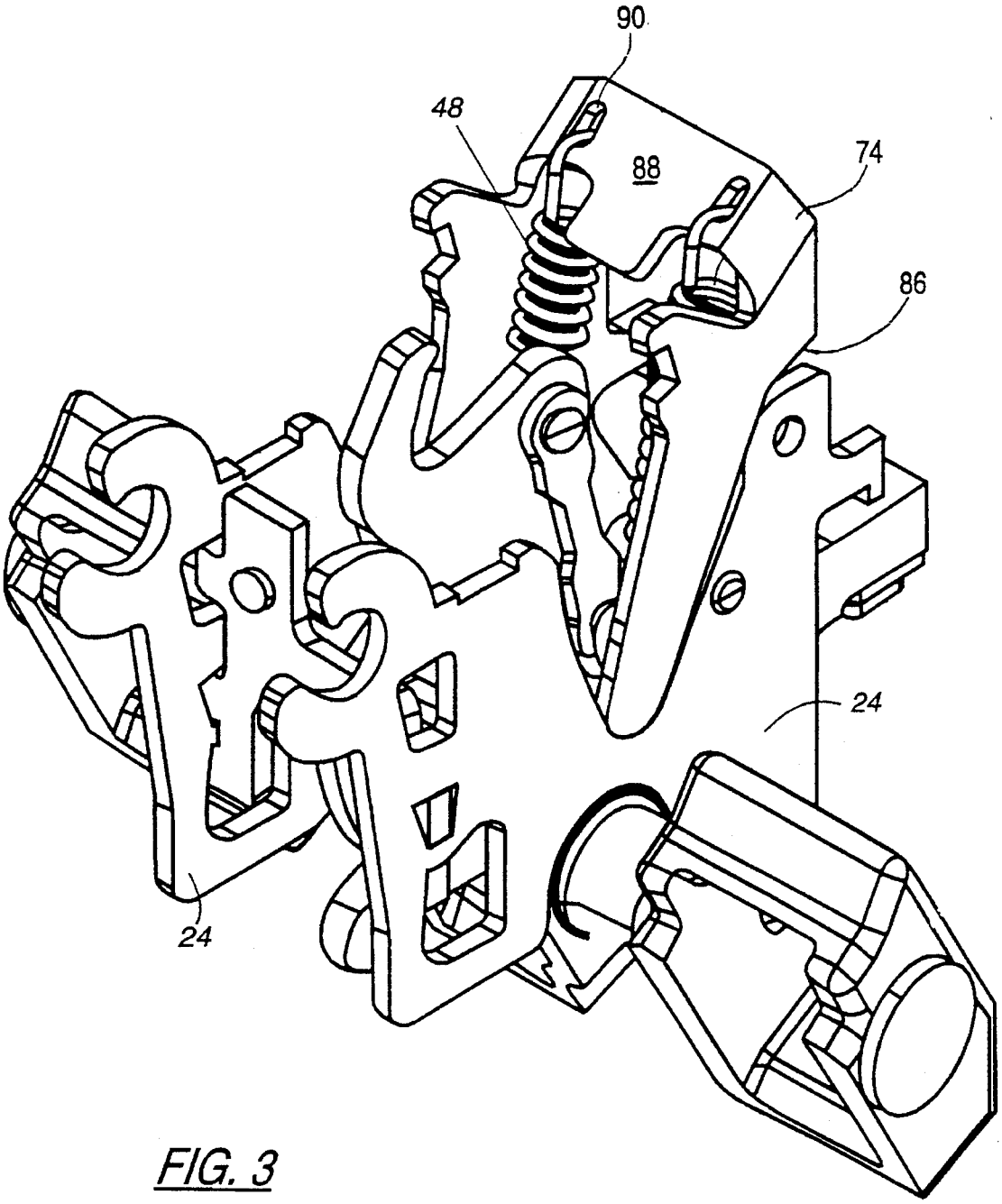
FIG. 3 is a perspective view of a blade/cradle assembly shown in an untripped position.

The lower surface of the handle base 82 is contoured to generally follow the lateral plate 88 and yet permit various circuit breaker mechanisms to fit between the base 82 and the lateral plate 88. For example, the lower surface of the base 82 is configured so as to create a gap 98 between the base 82 and the lateral plate 88 at the locations of the apertures 90 (FIG. 1). This gap 98 permits the ends of the toggle springs 48 to fit between the base 82 and the lateral plate 88 (FIG. 3).

Interlocking the handle 72 and the handle arm 74 allows for automated assembly because with the handle 72 attached the handle arm 74, the handle 72 will stay in position during assembly of the circuit breaker without the circuit breaker cover in place. In addition, the interlocking feature prevents any unwanted movement of the handle 72 while being operated.

The inner and outer shields 76, 78 are configured for positioning over the handle shaft 80 and on top of the handle base 82. More specifically, the shields 76, 78 include respective rectangular apertures 100, 102 to permit the shields to fit over the handle shaft 80. The apertures 100, 102 are slightly wider than the lower end of the shaft 80. The aperture 100 is only slightly longer than the lower end of the shaft 80, while the aperture 102 is substantially longer than the lower end of the shaft 80. In the assembled form of the handle assembly 70, the inner shield 76 is disposed over the handle shaft 80 such that it abuts the upper surface of the base 82, and the outer shield 78 is disposed over the handle shaft 80 on top of the inner shield 76. The handle 72 is provided with an elongated support 83 extending from the base 82 to aid in supporting the inner and outer shields 76, 78.

With regard to the circuit breaker enclosure, these shields 76, 78 are positioned between the enclosure cover and the upper surface of the base 82 with the handle shaft 80 protruding from the cover. The shields 76, 78 are prevented from falling off the handle shaft 80 because the upper surface of the base 82 firmly presses the shields 76, 78 against underside of the cover. This pressing action by the curved upper surface of the base 82 imparts the curvature to the shields 76, 78. The shields 76, 78 prevent an operator from coming into contact with the internal components of the circuit breaker while operating the handle 72. While operating the handle 72, the inner shield 76 is carried with the handle 72 between its various operating positions. Since the extreme operating positions of the handle 72 are farther apart than the length of the aperture 102 of the outer shield 78, the outer shield 78 is carried with the handle 76 at its extreme operating positions.

The handle 72 and the shields 76, 78 are composed of a polymeric material, while the handle arm 74 is composed of steel. The handle 72 is preferably manufactured by conventional injection compression molding techniques, while the shields 76, 78 and the handle arm 74 are manufactured by conventional stamping techniques.

While the invention has been particularly shown and described with reference to certain embodiments, it will be recognized by those skilled in the art that modifications and changes may be made to the present invention. Each of these embodiments and obvious variations thereof is contemplated as falling within the spirit and scope of the claimed invention, which is set forth in the following claims.

What is claimed is:

1. A handle assembly for a circuit breaker, comprising:

a unitary handle including a base, a shaft and a first pair of legs, said shaft extending from an upper surface of said base and said first pair of legs extending from a lower surface of said base, said first pair of legs forming respective first mating portions; and a unitary handle arm including a second pair of legs and a lateral plate bridging said second pair of legs, said second pair of legs forming respective second mating portions, said first mating portions slidably interlocking with respective ones of said second mating portions in response to common lateral movement of said first mating portions relative to each other so as to mount said handle to said handle arm.

2. The handle assembly of claim 1, wherein portions of said lower surface of said base abut said lateral plate and wherein said lower surface of said base is contoured to generally follow said lateral plate.

3. The handle assembly of claim 2, wherein said lower surface of said base includes a lateral retention ledge for engaging a lateral edge of said lateral plate.

4. The handle assembly of claim 2, wherein said lateral plate includes a pair of apertures and wherein said lower surface of said base is configured to form a gap between said lower surface and said lateral plate at the locations of said pair of apertures.

5. The handle assembly of claim 1, further including a first shield having a first aperture therein, said first shield abutting said upper surface of said base with said shaft extending through said first aperture.

6. The handle assembly of claim 5, further including a second shield having a second aperture therein, said second shield abutting said first shield with said shaft extending through said second aperture.

7. The handle assembly of claim 1, wherein said first mating portions include protrusions, and wherein said second mating portions include notches slidably receiving respective ones of said protrusions.

8. The handle assembly of claim 7, wherein said protrusions extend laterally into respective ones of said notches.

9. A handle assembly for a circuit breaker, comprising:

a unitary handle including a base, a shaft, and a first pair of legs, said shaft extending from an upper surface of said base and said first pair of legs extending from a lower surface of said base, said first pair of legs forming respective protrusions at lower ends thereof; and a unitary handle arm including a second pair of legs and a lateral plate bridging said second pair of legs, said second pair of legs forming respective notches slidably receiving said respective protrusions in response to common lateral movement of said protrusions relative to each other to mount said handle to said handle arm.

10. The handle assembly of claim 9, further including an inner shield having a first aperture therein, said inner shield abutting said upper surface of said base with said shaft extending through said first aperture, and an outer shield having a second aperture therein, said outer shield abutting said inner shield with said shaft extending through said second aperture.

11. The handle assembly of claim 9, wherein portions of said lower surface of said base abut said lateral plate and wherein said lower surface of said base is contoured to generally follow said lateral plate.

12. The handle assembly of claim 11 wherein said lower surface of said base includes a lateral retention ledge for engaging a lateral edge of said lateral plate.

* * * * *